US006170730B1

(12) United States Patent
Lin

(10) Patent No.: US 6,170,730 B1
(45) Date of Patent: Jan. 9, 2001

(54) NAIL ENGAGING DEVICE FOR ENGAGING NAILS CONNECTED BY WIRES AND PLASTIC PLATE

(75) Inventor: Rick Lin, Taichung (TW)

(73) Assignee: Basso Industry Corp., Taichung (TW)

( * ) Notice: Under 35 U.S.C. 154(b), the term of this patent shall be extended for 0 days.

(21) Appl. No.: 09/605,295

(22) Filed: Jun. 28, 2000

(51) Int. Cl.[7] ..... B25C 1/04
(52) U.S. Cl. ..... 227/119; 227/136
(58) Field of Search ..... 227/109, 119, 227/120, 136, 137, 135, 138

(56) References Cited

U.S. PATENT DOCUMENTS 5,240,161 * 8/1993 Kaneko ..... 227/136
5,332,141 * 7/1994 Mukoyama et al. ..... 227/136
5,738,266 * 4/1998 Ogawa ..... 227/119
5,772,098 * 6/1998 Crutcher ..... 227/119
6,024,268 * 2/2000 Horng-Lin ..... 227/120
6,032,848 * 3/2000 Smolinski ..... 227/119

* cited by examiner

*Primary Examiner*—Scott A. Smith
(74) *Attorney, Agent, or Firm*—Charles E. Baxley

(57) ABSTRACT

A nail engaging device of a nailer includes a cover pivotally connected to the barrel of the nailer and two recesses are defined in the cover. A first nail pushing member and a second nail pushing member are respectively received in the two recesses and two springs respectively urge the first nail pushing member and the second nail pushing member. A protrusion retractably extends from one of the two recesses and is located beside the second nail pushing member. The first nail pushing member and the second nail pushing member push the nails connected by wires in a nail feeding mechanism. When using nails connected by a plastic plate, the second nail pushing member is compressed by the second nail pushing member. The protrusion supports the plastic plate and pushes the nails into the barrel.

2 Claims, 7 Drawing Sheets

NAIL ENGAGING DEVICE FOR ENGAGING NAILS CONNECTED BY WIRES AND PLASTIC PLATE

FIELD OF THE INVENTION

The present invention relates to a nail engaging device of a power nailer wherein the device can be used for engaging nails connected by wires and nails connected by a plastic plate.

BACKGROUND OF THE INVENTION

A conventional nail engaging device for a power nailer is shown in FIG. 1 and generally includes a pushing member 11 located in the mechanism connected between a barrel of the nailer and a nail magazine. A piston 12 located below the pushing member 11 is able to be moved upward and downward when a trigger is pushed, and a nail reception recess 14 defined in the mechanism wherein nails are received in the nail reception recess 14. A cover 13 is pivotally connected to the barrel of the nailer and the cover 13 is able to cover the mechanism mentioned above. A pushing plate 10 extends from an inner surface of the cover 10 so that when the cover 13 is covered onto the mechanism, a gap is defined between the pushing plate 10 and a surface defining the nail reception recess 14 just allows a thickness of the nails 15 connected by wires as shown in FIG. 2A. In other words, the gap cannot receive the nails 16 connected by a plastic plate 17 as shown in FIG. 2B. If the user want to use the two types of nails, he/she has to prepare two different power nailers.

The present invention intends to provide a nail engaging device for a power nailer and which can be cooperated with the nails connected by a plate and wires.

SUMMARY OF THE INVENTION

In accordance with one aspect of the present invention, there is provided a nail engaging device of a nailer and comprising a cover connected to the barrel of the nailer and two recesses defined in the cover for receiving a first nail pushing member and a second nail pushing member therein. Two springs respectively urge the first nail pushing member and the second nail pushing member. A protrusion retractably extends from one of the two recesses and is located beside the second nail pushing member. The second nail pushing member is compressed by a plastic plate connecting nails and the nails is supported by the protrusion.

The primary object of the present invention is to provide a nail engaging device for a nailer wherein nails connected by wires and nails connected by a plastic plate can be used in the same nailer.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENT

Figure 3:
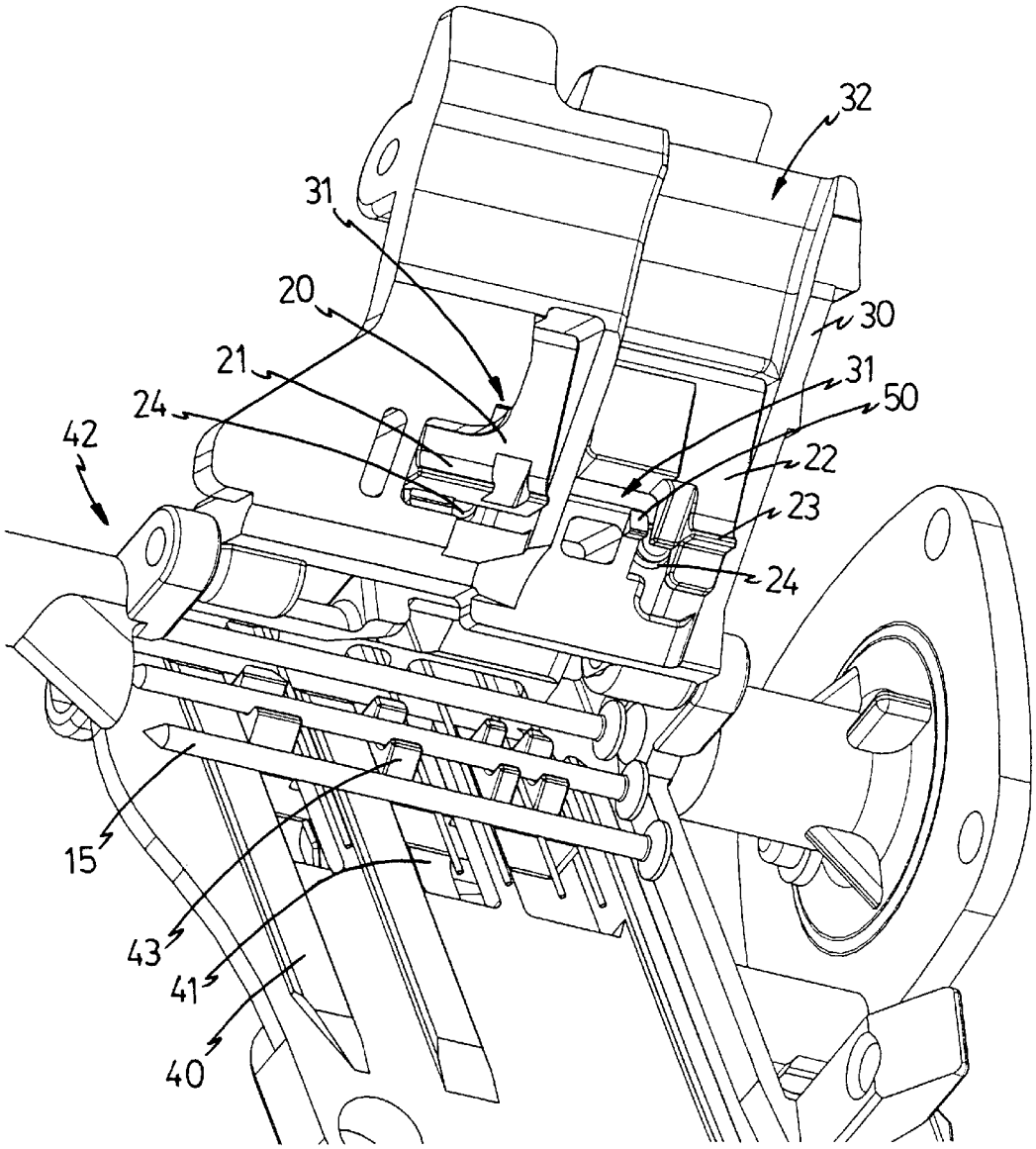
FIG. 3 is a perspective view to show a nail engaging device of the present invention.
Figure 4:
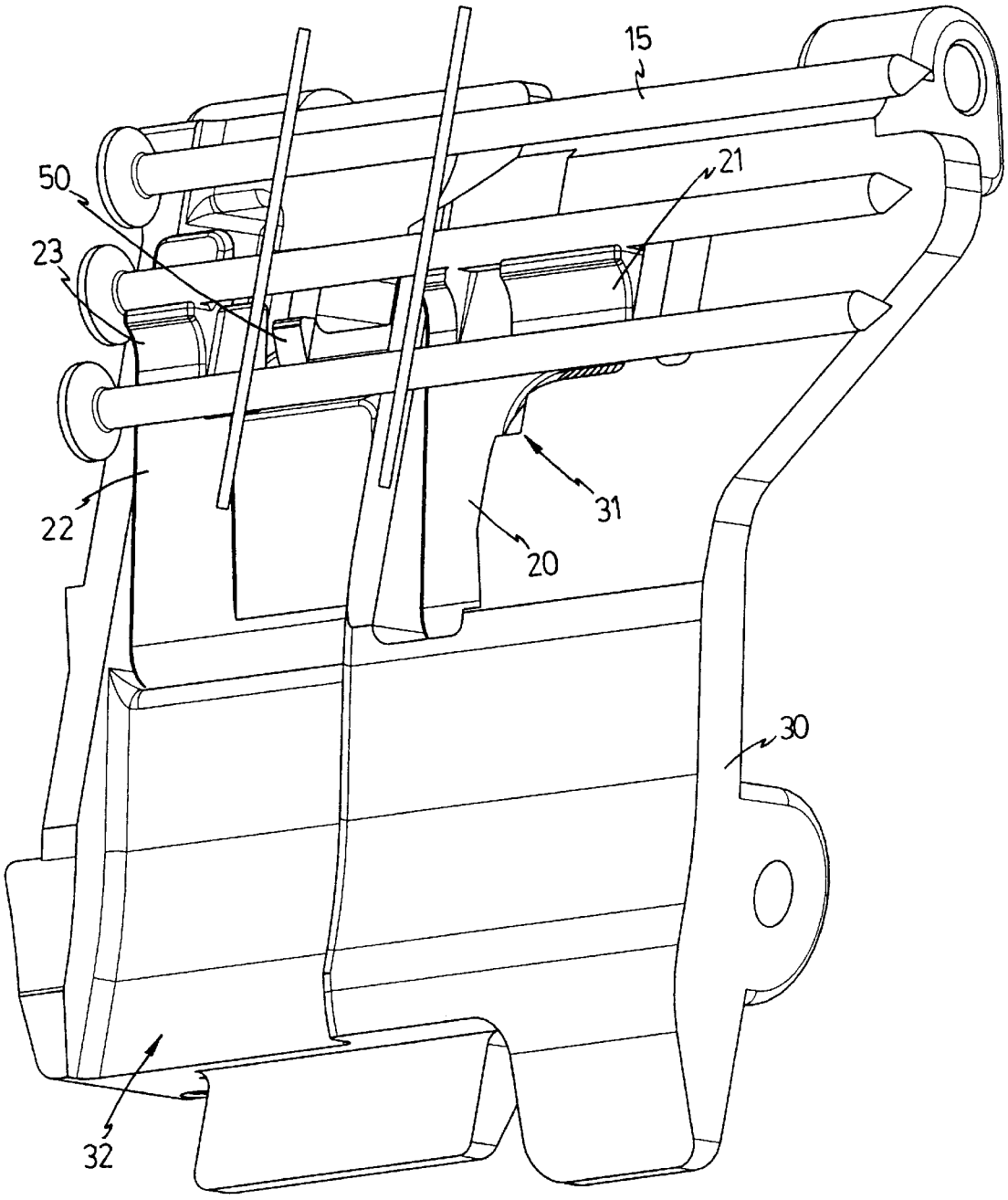
FIG. 4 is a perspective view to show nails connected by wires are engaged with the nail engaging device of the present invention.
Figure 5:
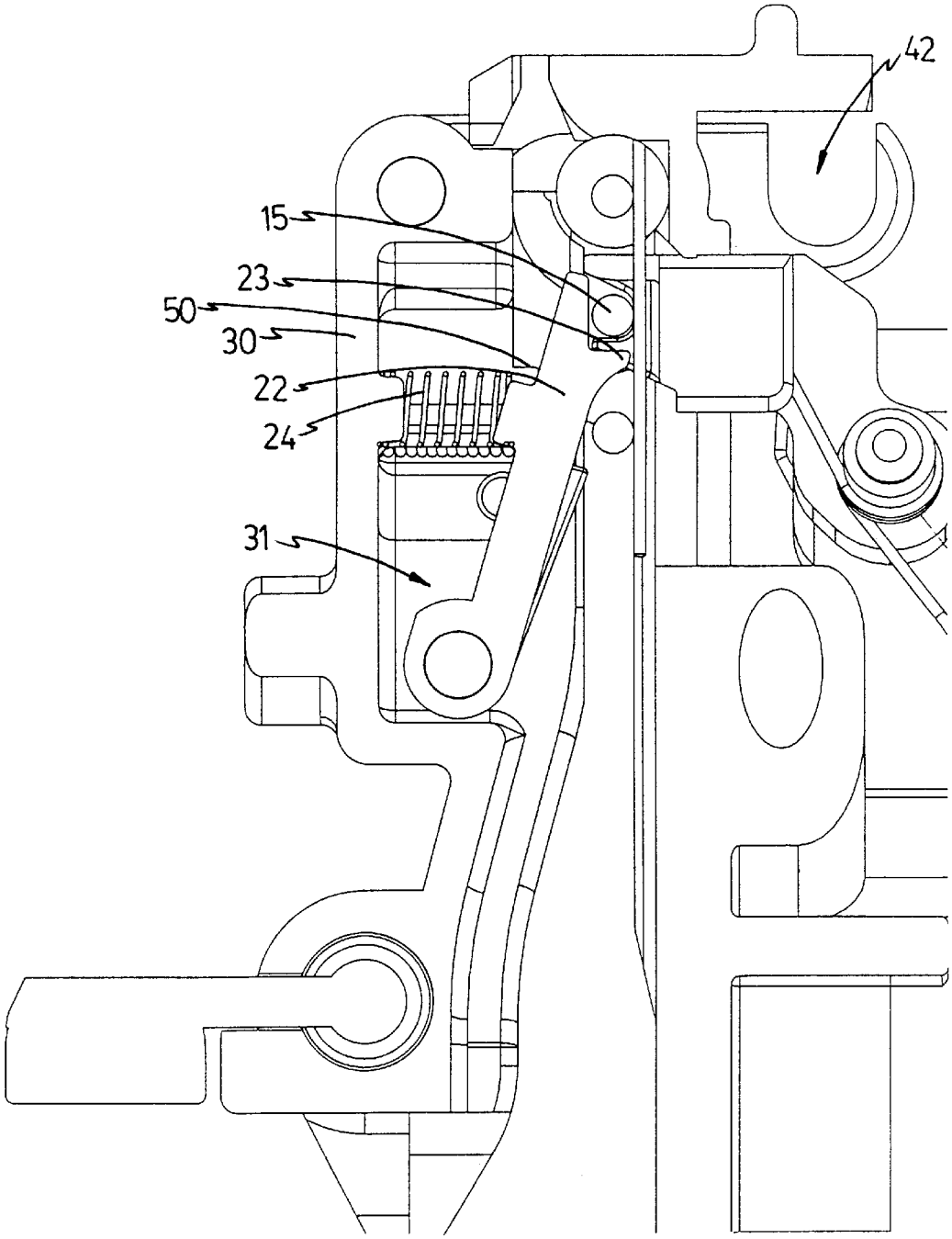
FIG. 5 is a front view to show the nails connected by wires are engaged with the nail engaging device of the present invention.

Referring to FIGS. 3 to 5, the nail engaging device of the present invention comprises a cover 30 pivotally connected to the barrel of the nailer and having a nail guide groove 32 defined therein. Two recesses 31 are defined in the cover 30 and a first nail pushing member 20 and a second nail pushing member 22 are respectively received in the two recesses 31. Two springs 24 respectively urge the first nail pushing member 20 and the second nail pushing member 22. A protrusion 50 retractably extends from one of the two recesses 31 and is located beside the second nail pushing member 22. A first nail support member 21 and a second nail support member 23 are respectively located beside the first nail pushing member 20 and the second nail pushing member 22.

Figure 1:
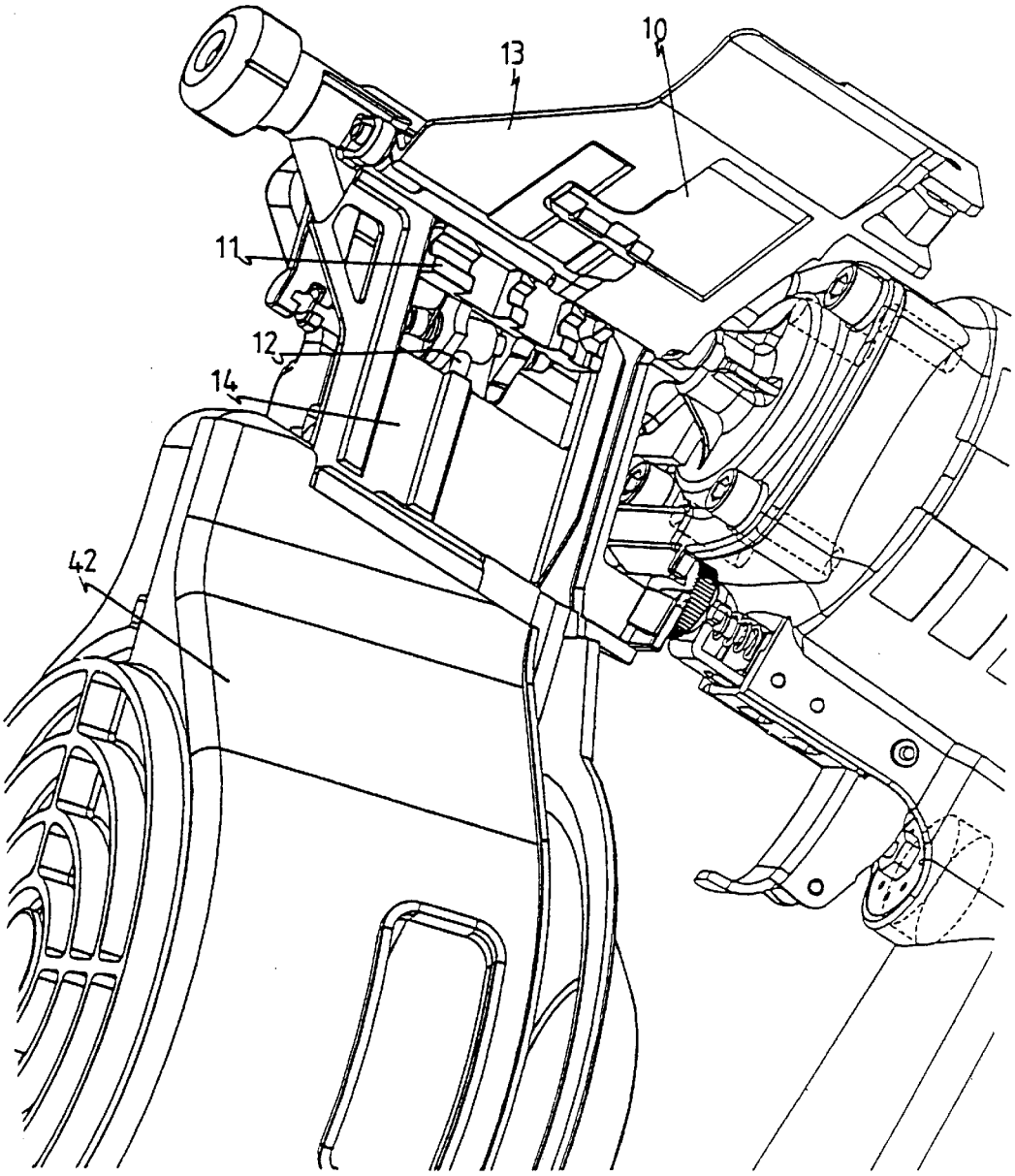
FIG. 1 PRIOR ART
FIG. 1 is a perspective view to show a conventional nail engaging device of a nailer.
Figure 2A:
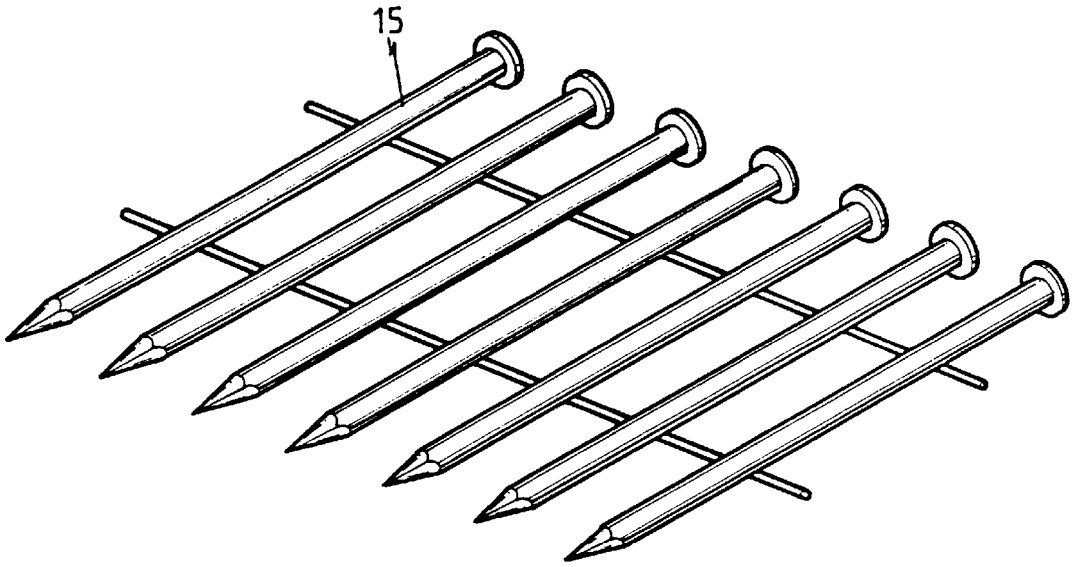
FIG. 2A PRIOR ART
FIG. 2A is a perspective view to show nails connected by wires.
Figure 2B:
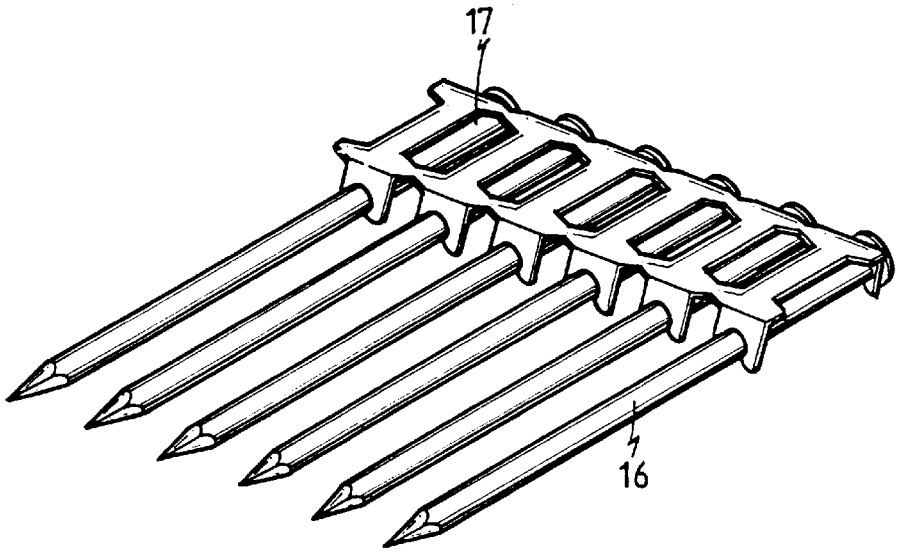
FIG. 2B PRIOR ART
FIG. 2B is a perspective view to show nails connected by a plastic plate.

The nailer which has a nail feeding mechanism 42 connected to the barrel of the nailer and the cover 30 is able to engage to the nail feeding mechanism 42. Nails as shown in FIGS. 2A and 2B are to be received between the cover 30 and the nail feeding mechanism 42. The nail feeding mechanism 42 has grooves 41 defined therein and a plurality of nail supporting members 43 connected by a plate are retractably received in the grooves 41.

When using nails 15 connected by wires, the leading nail is inserted in the barrel and the second nail is supported by the first nail support member 21, the second nail support member 23 and the nail supporting members 43. When the trigger is pulled, the leading nail is ejected and the nail supporting members 43 are pulled away from the barrel. Because the second nail is stopped by the first nail support member 21, the second nail support member 23 so that nail the supporting members 43 are retracted and pass the second nail and then engage the third nail. When the nail engaging members 43 are moved toward the barrel, the second nail is pushed to compress the first nail pushing member 20 and the second nail pushing member 22, and then sent into the barrel and ready for shoot.

Figure 6:
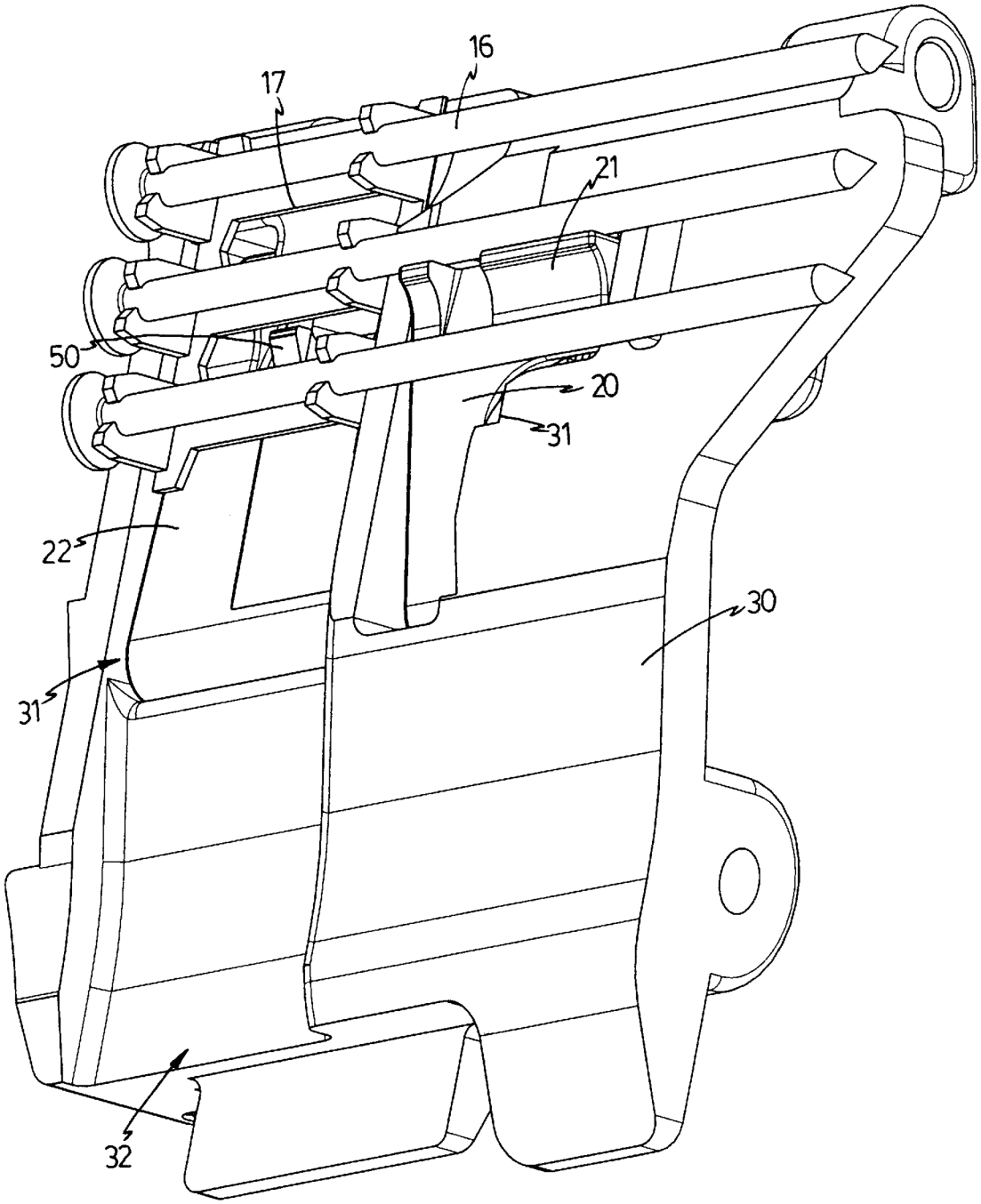
FIG. 6 is a perspective view to show nails connected by a plastic plate are engaged with the nail engaging device of the present invention.
Figure 7:
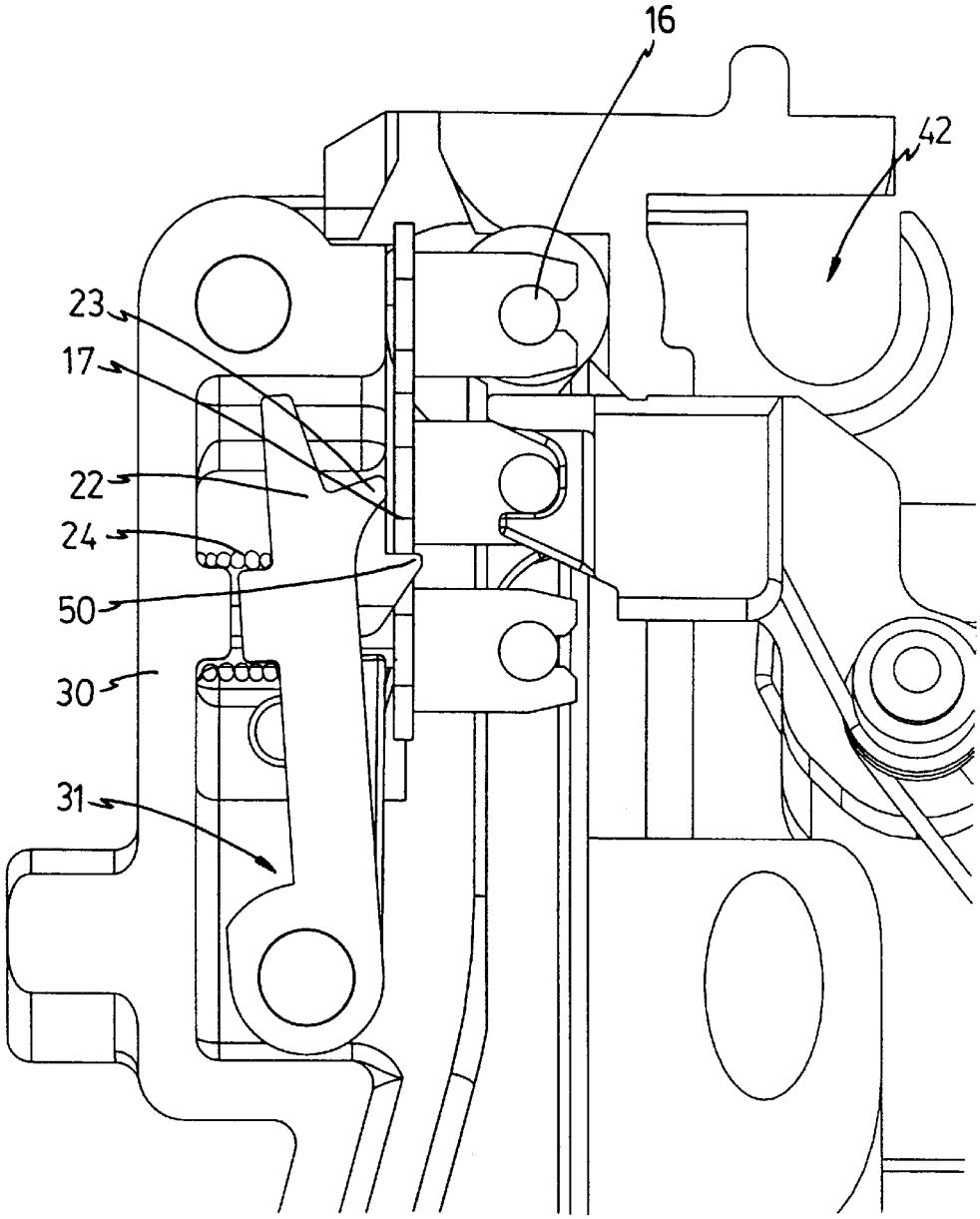
FIG. 7 is a front view to show the nails connected by the plastic plate are engaged with the nail engaging device of the present invention.

As shown in FIGS. 6 and 7, when using the nails 16 connected by a plastic plate 17, the second nail pushing member 22 is pushed into the recess 31 by the plastic plate 17. However, the protrusion 50 engages with an aperture of the plastic plate 17. Therefore, the nail engaging device is able to cooperate with nails connected by wires and by a plastic plate 17.

While we have shown and described various embodiments in accordance with the present invention, it should be clear to those skilled in the art that further embodiments may be made without departing from the scope and spirit of the present invention.

What is claimed is:

1. A nail engaging device of a nailer which has a nail feeding mechanism connected to a barrel of the nailer, the nail feeding mechanism having grooves defined therein and nail supporting members retractably received in said grooves, said nail engaging device comprising:

a cover adapted to be connected to the barrel of the nailer and two recesses defined in said cover, a first nail pushing member and a second nail pushing member respectively received in said two recesses and two springs respectively urging said first nail pushing member and said second nail pushing member, a protrusion retractably extending from one of said two recesses and located beside said second nail pushing member.

2. The nail engaging device as claimed in claim 1, wherein said cover has a nail guide groove defined therein.

* * * * *